US005718573A

United States Patent [19]

Knight et al.

[11] Patent Number: 5,718,573

[45] Date of Patent: Feb. 17, 1998

[54] FLASHBACK RESISTANT BURNER

[75] Inventors: Brian A. Knight, Tolland; William P. Patrick; Daniel J. Seery, both of Glastonbury; Martin F. Zabielski, Manchester, all of Conn.

[73] Assignee: Carrier Corporation, Syracuse, N.Y.

[21] Appl. No.: 364,378

[22] Filed: Dec. 27, 1994

[51] Int. Cl.[6] ..... F23D 14/62

[52] U.S. Cl. ..... 431/354; 431/353; 431/346; 126/116 R

[58] Field of Search ..... 431/8, 2, 9, 10, 431/156, 157, 346, 350–354, 181, 187, 278; 126/110 R, 99 R, 116 R

[56] References Cited

U.S. PATENT DOCUMENTS

| | | | |
|---|---|---|---|
| 554,253 | 2/1896 | Finlay | 431/346 |
| 1,354,295 | 9/1920 | Hamilton | 431/346 |
| 3,155,142 | 11/1964 | Stack | 431/346 |
| 4,077,761 | 3/1978 | Dollinger et al. | 431/353 |
| 5,370,529 | 12/1994 | Lu et al. | 431/353 |

FOREIGN PATENT DOCUMENTS

| | | | |
|---|---|---|---|
| 155431 | 7/1987 | Japan | 431/346 |

*Primary Examiner*—James C. Yeung

[57] ABSTRACT

A flashback resistant burner for lean fuel/air mixtures includes apparatus for mixing a primary fuel and combustion air to form a noncombustible fuel/air mixture. Means are provided for accelerating the noncombustible fuel/air mixture to a velocity higher than the flame speed of a combustible mixture of the primary fuel and air. Means are further provided for mixing a secondary fuel with the accelerated noncombustible fuel/air mixture to form a combustible fuel/air mixture that has an equivalence ratio less than 1. Means are then provided for burning the combustible fuel/air mixture.

19 Claims, 6 Drawing Sheets

FLASHBACK RESISTANT BURNER

BACKGROUND OF THE INVENTION

1. Field of the Invention

This invention is directed to a flashback resistant burner for lean fuel/air mixtures.

2. Description of the Prior Art

Continued concern about atmospheric pollution has created renewed interest in lowering the emissions from various combustion devices. Of particular concern are nitric oxide (NO) and nitrogen dioxide ($NO_2$) emissions because of their roles in forming ground level smog and acid rain, and in depleting stratospheric ozone. For simplicity, NO and $NO_2$ are frequently grouped together as $NO_x$. Many jurisdictions have proposed stringent $NO_x$ emissions limitations. For example, California has considered limiting $NO_x$ omissions from stationary combustion devices to a maximum of 15 ng/J. To control $NO_x$ formation, many modem combustors bum fuel that has little or no nitrogen and operate with lean fuel/air mixtures. A lean fuel/air mixture has more than a stoichiometric amount of air. The leanness of a fuel/air mixture is measured by the percentage of excess air or by the mixture's equivalence ratio. The equivalence ratio is the ratio of the mixture's actual fuel/air ratio to the stoichiometric fuel/air ratio. The lowest equivalence ratio at which a fuel/air mixture is combustible is referred to as the "lean flammability limit". For natural gas at atmospheric pressure and room temperature, the lean flammability limit is an equivalence ratio of about 0.55.

A known technique for achieving fuel-lean operation is to premix the fuel with combustion air before burning it. Such premixing allows the fuel and air to mix completely, eliminating fuel-rich pockets that may result in increased $NO_x$ production.

A drawback to premixing the fuel and air, however, is that it creates a combustible mixture that is prone to flame flash back, auto ignition, and detonation. Such hazards are unacceptable in most burners, including particularly those in home heating units.

It will thus be appreciated then, that what is needed in the industry is a lean, premixed burner that resists flame flashback, auto ignition, and detonation.

SUMMARY OF THE INVENTION

The present invention is directed to a lean, premixed burner that resists flame flashback, auto ignition, and detonation.

In one embodiment, such a burner is achieved by providing means for mixing a primary fuel and combustion air to form a non combustible fuel/air mixture. Means are provided for accelerating the noncombustible fuel/air mixture to a velocity higher than the flame speed of a combustible mixture of the primary fuel and air. Means are further provided for mixing a secondary fuel with the accelerated noncombustible fuel/air mixture to form a combustible fuel/air mixture that has an equivalence ratio less than one. Means are then provided for burning the combustible fuel/air mixture.

According to another embodiment means are provided for decelerating the combustible fuel/air mixture before burning it. In a specific embodiment the means for mixing the primary fuel and combustion air include means for imparting a swirling flow to the noncombustible mixture.

BRIEF DESCRIPTION OF THE DRAWINGS

The novel features that are considered characteristic of the invention are set forth with particularity in the appended claims. The invention itself, both as to its organization and its method of operation, together with additional objects and advantages thereof, will best be understood from the following description of the preferred embodiments when read in connection with the accompanying drawings wherein like numbers have been employed in the different figures to denote the same parts, and wherein:

DESCRIPTION OF THE PREFERRED EMBODIMENT

The present invention combines aerodynamic techniques with staged fuel mixing to produce a flash back resistant burner for lean fuel/air mixtures. Initially, a fraction of the fuel mixes with all of the combustion air to form a noncombustible mixture. The fuel that mixes with the air to make the noncombustible mixture will be called the "primary fuel". The mount of primary fuel depends on the specific fuel and the particular application of the burner. As an example, in a natural gas fueled burner, about 20% to about 80% of the fuel may be primary fuel. The noncombustible mixture permits the primary fuel and air to mix thoroughly without creating the potential danger of a flashback, auto ignition, or detonation. Preferably, the primary fuel and air will be mixed with aerodynamic techniques, such as a swirling flow as described below.

While the primary fuel and air mix, the noncombustible mixture is accelerated to a velocity that is higher than the flame velocity of a combustible mixture of the primary fuel and air. For example, if the primary fuel is natural gas, and if the final mixture is desired to be at the stoichiometric condition, the noncombustible mixture should be accelerated to a velocity greater than about 45 cm/sec. The high speed flow creates an aerodynamic barrier to flame propagation that prevents flash back even in the presence of a combustible mixture of primary fuel and air. The combination of this aerodynamic barrier with the noncombustible mixture provides two safeguards against flashback in the upstream portion of a burner according to the present invention.

With the noncombustible mixture flowing at the desired high velocity, the remaining fuel is added to the fuel/air mixture. The remaining fuel is called the secondary fuel. The amount of secondary fuel should be sufficient to create a combustible mixture after it mixes with the primary fuel and air. Preferably, aerodynamic techniques will be used to mix the secondary fuel with the noncombustible mixture rapidly over a short distance.

As the secondary fuel continues to mix with the primary fuel and air, the velocity of the mixture is decelerated. The deceleration results in a decrease in flow velocity to a level that is still above the flame velocity, consistent with the stoichiometry of the mixture. The fuel/air mixture, now a combustible mixture, is then burned. This staged mixing method, combined with rapid aerodynamic mixing, limits the possible flash back, auto ignition, and detonation hazards to a small region at the down stream end of the burner, where flash back, auto ignition and detonation are least likely to be dangerous. As described below, the use of a flame holder can further reduce the likelihood of flash back, while stabilizing the time.

Figure 1:
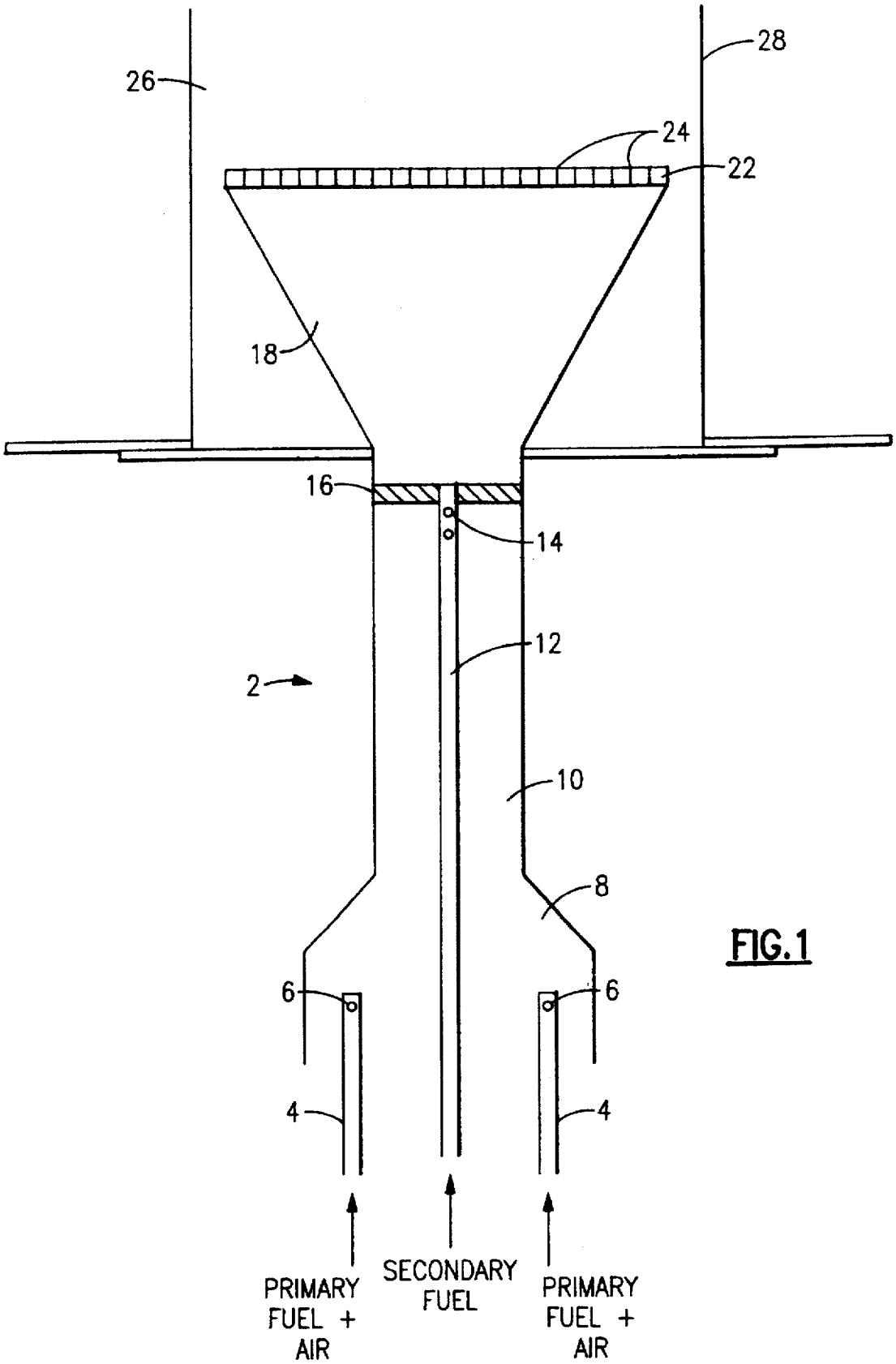
FIG. 1 is a schematic cut away view of a burner of the present invention.

FIG. 1 shows a basic embodiment of a burner 2 of the present invention. The primary fuel and air, which may be pre-mixed, enter a mixing zone 8 through orifices 6 injection nozzles 4. The orifices 6 are configured such that they direct the fuel and air non-axially or tangentially into the mixing zone 8 to create a swirling flow that uniformly mixes the fuel and air to create a noncombustible mixture. The swirling, noncombustible fuel/air mixture then enters an acceleration zone 10 where it accelerates to a velocity greater than the flame speed for a combustible mixture of the primarily fuel. The dimensions of the acceleration zone 10 can be selected to provide a desired velocity. At the downstream end of the acceleration zone 10 a secondary fuel enters the burner through orifices 14 in a secondary fuel nozzle 12. The orifices 14, located at the center line of the acceleration zone 10, are configured to direct the secondary fuel into the vortex created by the swirling, noncombustible mixture in a counter flow direction. Injecting the secondary fuel into the vortex in a counterflow direction creates high shear, which provides rapid and thorough mixing. The fuel and air stream then flows through a plurality of deswirling vanes 16 that enhance mixing and disrupt the swirling flow. If the swirling flow is not disrupted, the downstream flame may have an undesirable toroid shape.

Figure 2:
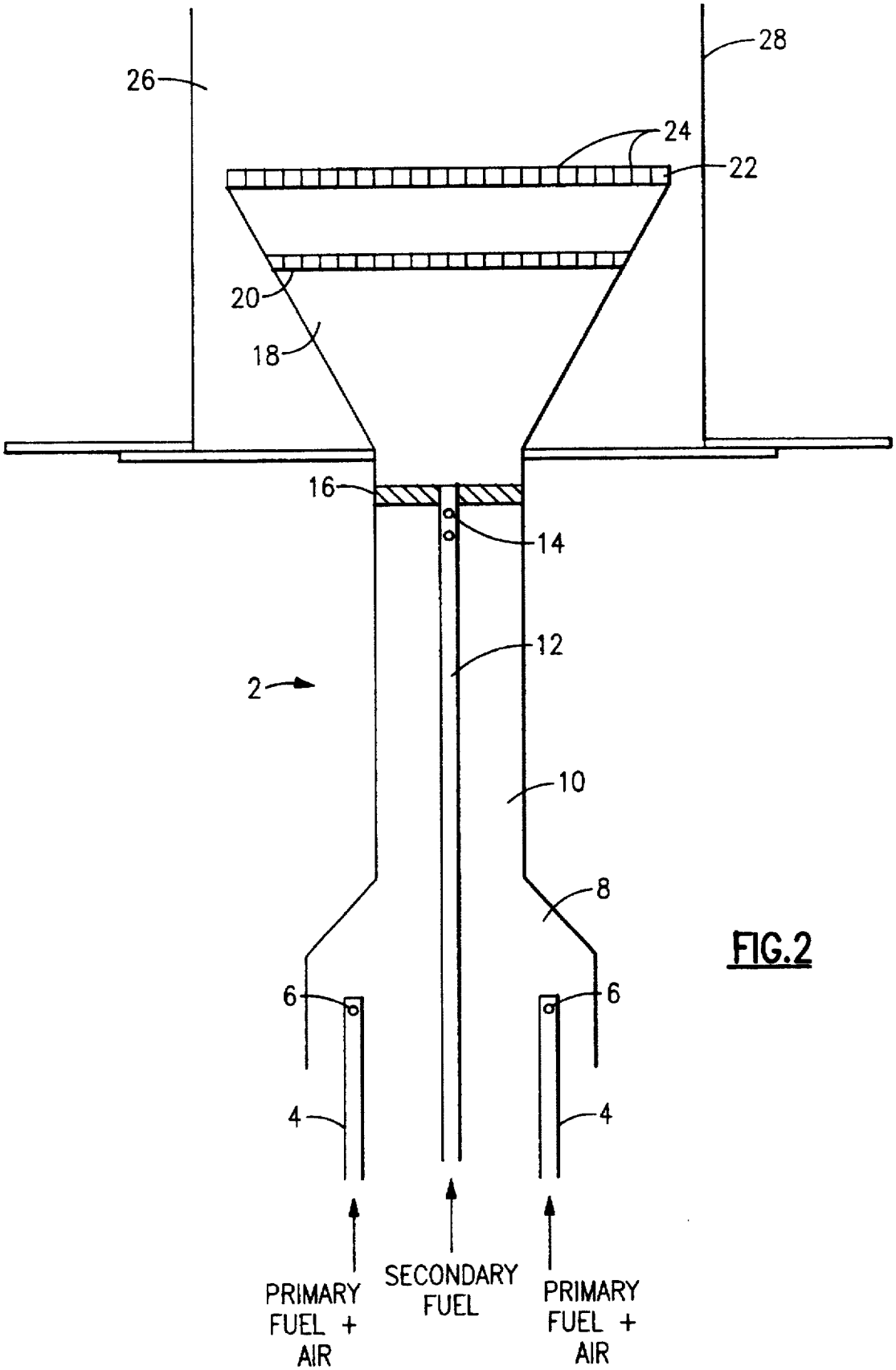
FIG. 2 is a view of a burner similar to that of FIG. 1 which includes a perforated plate to slow the combustible mixture in the deceleration zone.

After passing through the deswirling vanes 16, the now combustible fuel/air mixture enters a deceleration zone 18 where it expands and slows to a velocity that will support combustion. If desired, the combustible mixture may be further slowed with a perforated plate 20 or similar device, as shown in FIG. 2. The fuel air mixture then passes through a flame holder 22 before burning in a combustion chamber 26. The flame holder 22 may be any suitable flame holder such as the perforated plate illustrated in simplified form in the drawing Figures. The flame holder 22 has a plurality of holes 24 through which the flow accelerates, creating another aerodynamic barrier between the flame and combustible mixture. The flame holder 22 also creates a stable flame in the combustion chamber 26.

Figures 3, 4:
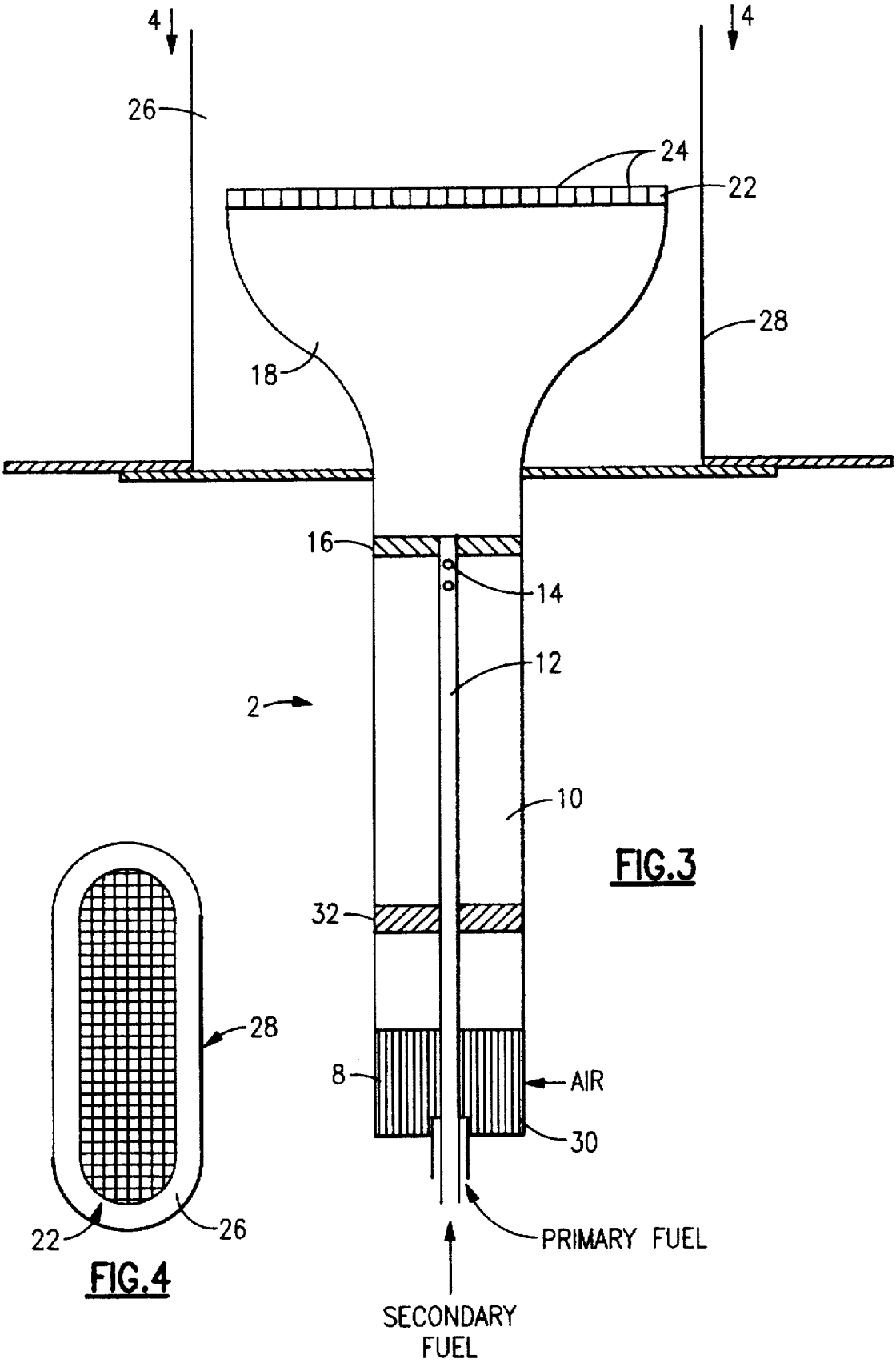
FIG. 3 is a schematic cut away, view of another burner of the present invention.
FIG. 4 is a cross sectional view of the flame holder of the burner depicted in FIG. 3.
Figure 5:
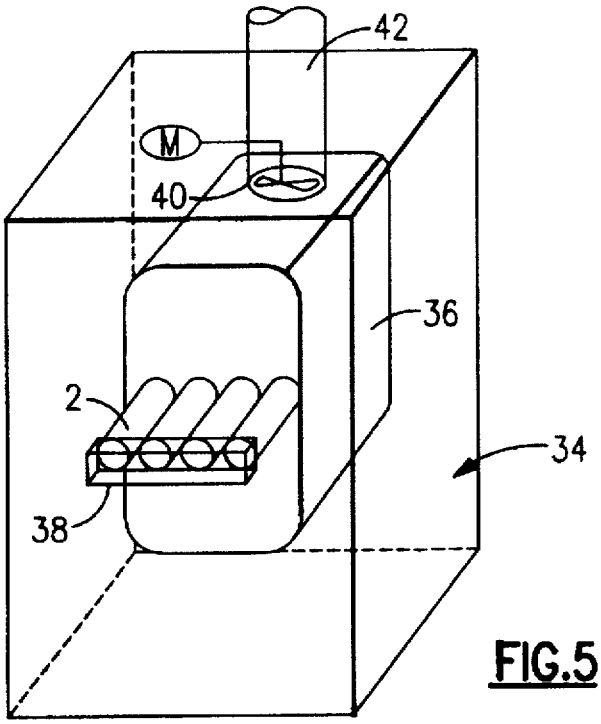
FIG. 5 is a simplified perspective view of a residential furnace which incorporates burners of the present invention.

FIG. 3 shows another embodiment of the burner of the present invention. In this embodiment, the primary fuel enters the mixing zone 8 through an injection nozzle 4. The combustion air enters the mixing zone 8 through a slotted wall 30 that provides a low pressure drop and promotes formation of the noncombustible mixture. As is evident from FIG. 3 the primary fuel and the air enter the mixing zone 8 in direction substantially perpendicular to one another to further promote mixing. The noncombustible mixture accelerates in the acceleration zone 10 and passes over a plurality of swirling vanes 32 that impart a swirling flow to the mixture. As in the previous embodiments, the swirling flow uniformly mixes the primary fuel and air. The noncombustible mixture then mixes with the secondary fuel to form a combustible mixture that is burned as described in connection with the embodiment of FIG. 2. FIG. 4 is cross-sectional view of the flame holder 22 which is surrounded by a heat exchanger wall 28 that inpart defines the combustion chamber 26. FIG. 5 illustrates how the burners 2 of the present invention may be incorporated into a typical induced draft residential furnace 34. A plurality of burners 22 are inserted into a combustion chamber (not shown) that is in the interior of a heat exchanger 36. Combustion air is supplied through an air plenum 38 that surrounds the upstream ends of the burners 2. Exhaust gases are removed from the combustion chamber by an induced draft fan 40 through a flue 42.

Figure 6:
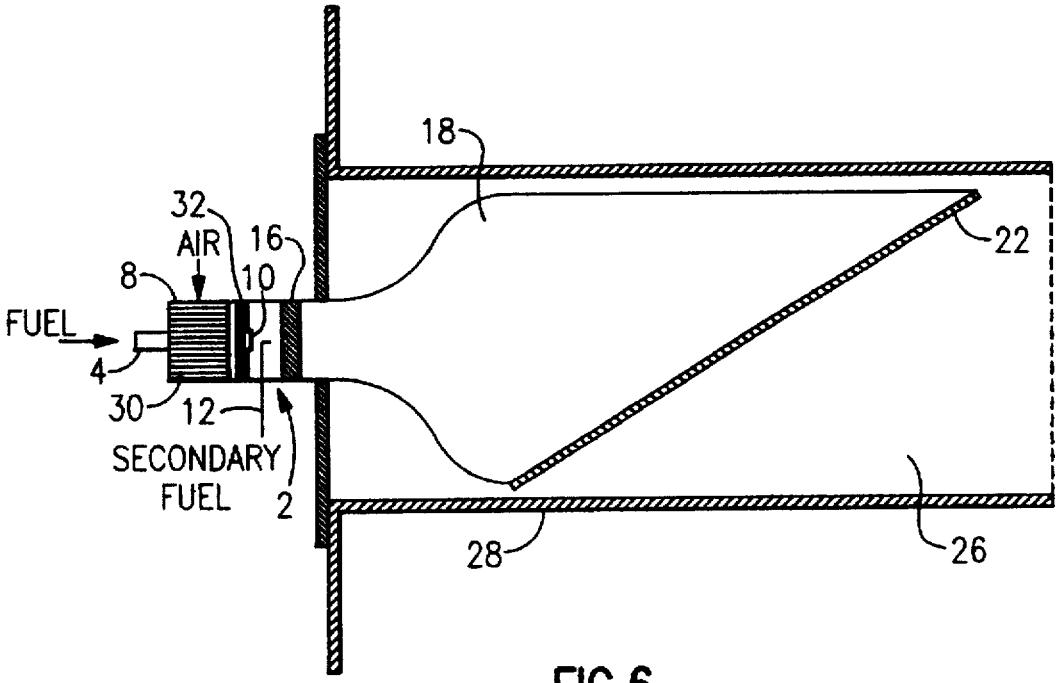
FIG. 6 is a schematic cut away, view of a burner of the present invention suitable for use in a residential gas fired furnace.

FIG. 6 shows an alternate configuration for the deceleration zone 18 and flame holder 22 of a burner that can be useful in a residential furnace. The angled configuration of the flame holder 22 is able to provide better flame distribution along the heat exchanger wall 28, leading to better heat transfer.

Figure 7:
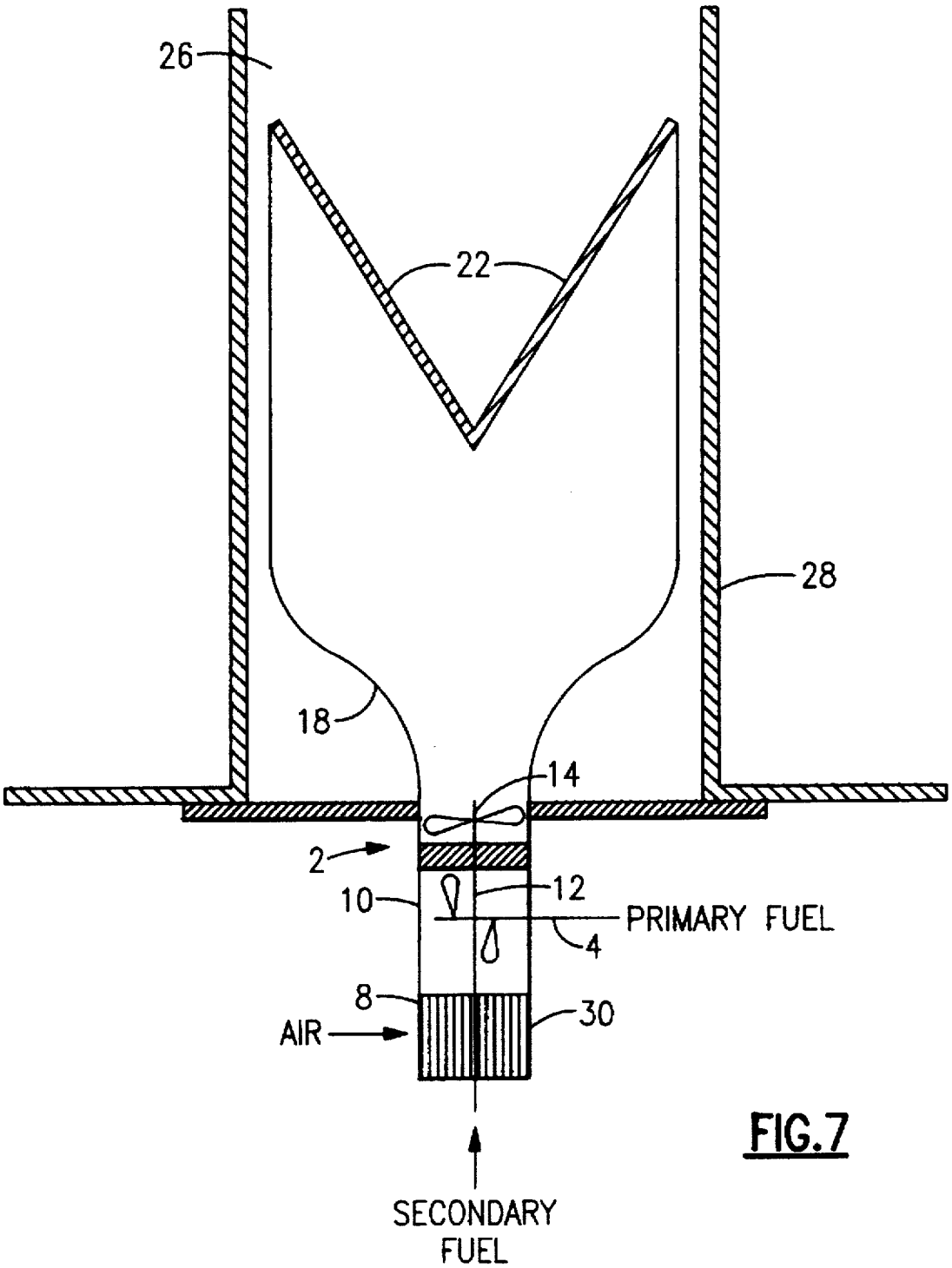
FIG. 7 is a schematic cut away view of another burner of the present invention suitable for use in a residential gas furnace.

FIG. 7 shows still another alternate configuration for the burner 2, the deceleration zone 18 and the flame holder 22 which also can be useful in a residential furnace. In this embodiment it will be noted that the primary fuel is injected through orifices 6 in an injection nozzle 4 downstream from the air inlet slots 30. Deswirling vanes 16 are located near the end of the acceleration zone 10 with the secondary fuel inlet orifices 14 located downstream from the deswirling vanes.

The flame holder 22 has a concave configuration which serves to direct the high temperature flame away from the heat exchanger wall 28 to preclude thermal damage to the wall while leading to better heat transfer and lower emissions of toxic gases such as carbon monoxide (CO).

The present invention is compatible with a wide range of fuels, including gaseous fuels, prevaporized liquid fuels, and micronized solid fuels. Suitable gaseous fuels include natural gas, methane, propane, hydrogen and butane. Suitable liquid fuels include turbine fuels, heating oils, and other distillate fuels. The liquid fuels must be prevaporized or decomposed into gaseous fuels before entering a burner of the present invention. Suitable micronized solid fuels may include coal. The selected fuel may be used as both a primary and secondary fuel. If desired, however, different fuels may be used as primary and secondary fuels. For example, if the primary fuel is micronized coal, it may be desirable for the secondary fuel to be a gaseous fuel or a prevaporized liquid fuel.

Figure 8:
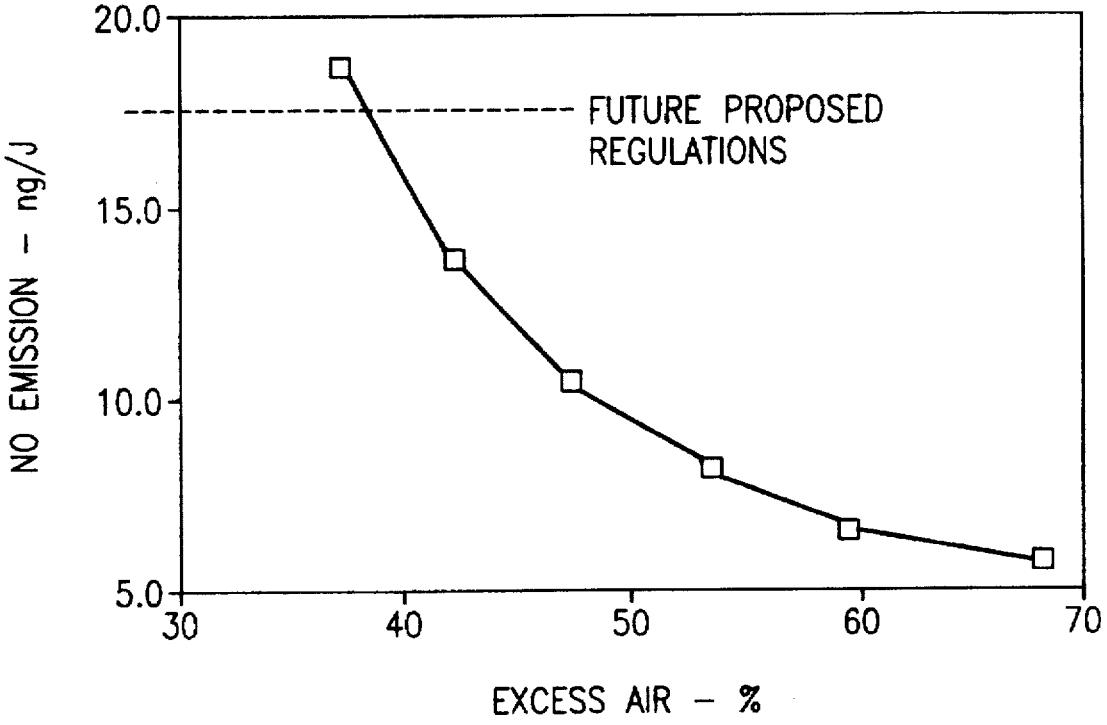
FIG. 8 graphically illustrates emissions data obtained with a burner of the present invention.

FIG. 8 illustrates NO concentration versus excess air for a burner 10 of the type generally illustrated in FIGS. 6 and 7. The burner was operating with natural gas as both the primary and secondary fuel, at a firing rate of 20,000 BTU/hr.

It will be noted with reference to FIG. 8 that for excess air exceeding about 40% emissions levels were well below future proposed regulations regarding NO emissions.

This invention may be practiced or embodied in still other ways without departing from the spirit or essential character thereof. The preferred embodiments described herein are therefore illustrative and not restrictive, the scope of the invention being indicated by the appended claims and all variations which come within the meaning of the claims are intended to be embraced therein.

What is claimed is:

1. A flashback-resistant burner, comprising:

a. means for uniformly mixing a primary fuel and combustion air to form a non combustible fuel/air mixture;

b. means for accelerating the non combustible fuel/air mixture to a velocity higher than the flame speed of a combustible mixture of the primary fuel and air;

c. means for mixing a secondary fuel with the accelerated non combustible fuel/air mixture to form a combustible fuel/air mixture; and d. means for burning the combustible fuel/air mixture.

2. The burner of claim 1 wherein the combustible fuel/air mixture has an equivalence ratio less than 1.0.

3. The burner of claim 1 further comprising means for decelerating the combustible fuel/air mixture before burning it.

4. The burner of claim 1 wherein the means for mixing the primary fuel and combustion air imparts a swirling flow to the noncombustible mixture.

5. The burner of claim 4 wherein the swirling flow is created by fuel and air non-axially entering a mixing zone.

6. The burner of claim 5 wherein the fuel and air tangentially entering said mixing zone.

7. The burner of claim 4 therein the swirling flow is created by a plurality of swirling vanes.

8. The burner of claim 1 wherein the primary fuel is natural gas and the noncombustible fuel/air mixture has an equivalence ratio of about 0.4 or less.

9. The burner of claim 1 wherein the noncombustible fuel/air mixture has an equivalence ratio below the lean flammability limit for the primary fuel.

10. The burner of claim 1 wherein the means for mixing the secondary fuel with the accelerated noncombustible fuel/air mixture includes means for adding the secondary fuel countercurrent to the accelerated noncombustible fuel/air mixture.

11. The burner of claim 1 wherein the means for mixing the secondary fuel with the accelerated noncombustible fuel/air mixture includes a plurality of deswirling vanes.

12. The burner of claim 1 wherein the means for burning the combustible fuel/air mixture includes a flame holder.

13. The burner of claim 1 wherein the primary and secondary fuels are selected from the group consisting of gaseous fuels, prevaporized liquid fuels, and micronized solid fuels.

14. The burner of claim 1 wherein the primary and secondary fuels are the same fuel.

15. The burner of claim 1 wherein the primary fuel is micronized coal and the secondary fuel is selected from the group consisting of gaseous fuels and prevaporized liquid fuels.

16. The apparatus of claim 1 wherein both said primary and secondary fuels are natural gas, and said non combustible fuel/air mixture has an equivalence ratio about 0.4 or less, and said means for burning comprises a flame holder.

17. The apparatus of claim 16 wherein said flame holder is a perforated plate.

18. A natural gas furnace having a burner box containing a plurality of combustion burners, each of the burners for directing heat into a corresponding heat exchanger to heat a flow of circulating air passing over the heat exchangers, each of the burners comprising;

a. means for uniformly mixing natural gas and combustion air to form a noncombustible natural gas/air mixture;

b. means for accelerating the noncombustible natural gas/air mixture to a velocity higher than the flame speed of a combustible mixture of natural gas and air;

c. means for mixing additional natural gas with the accelerated noncombustible natural gas/air mixture to form a combustible natural gas/air mixture; and d. means for burning the combustible fuel/air mixture.

19. The apparatus of claim 1 wherein said noncombustible natural gas/air mixture has an equivalence ratio of about 0.4 or less, and wherein said combustible natural gas/air mixture has an equivalence ratio less than 1.0.

* * * * *